United States Patent [19]

Borduz et al.

[11] Patent Number: 4,604,222

[45] Date of Patent: Aug. 5, 1986

[54] STABLE FERROFLUID COMPOSITION AND METHOD OF MAKING AND USING SAME

[75] Inventors: Lucian Borduz, Nashua; Kuldip Raj, Merrimack, both of N.H.

[73] Assignee: Ferrofluidics Corporation, Nashua, N.H.

[21] Appl. No.: 736,388

[22] Filed: May 21, 1985

[51] Int. Cl.[4] ..... H01F 1/25

[52] U.S. Cl. ..... 252/62.52; 252/62.51; 252/62.55

[58] Field of Search ..... 252/62.51, 62.52, 62.55

[56] References Cited

U.S. PATENT DOCUMENTS

| | | | |
|---|---|---|---|
| 3,635,819 | 1/1972 | Kaiser | 252/62.51 R |
| 3,700,595 | 10/1972 | Kaiser, II | 252/62.51 R |
| 3,764,540 | 10/1973 | Khalafalla | 252/62.54 |
| 3,917,538 | 11/1975 | Rosenweig | 252/62.52 |
| 3,981,844 | 9/1976 | Romankiw | 252/62.51 R |
| 4,224,396 | 9/1980 | Pollet | 252/62.54 |
| 4,430,239 | 2/1984 | Wyman | 252/62.51 |
| 4,543,312 | 9/1985 | Murakawa et al. | 252/62.51 |

FOREIGN PATENT DOCUMENTS

| | | | |
|---|---|---|---|
| 1168855 | 6/1984 | Canada | 252/62.51 |

OTHER PUBLICATIONS

Bradshaw, et al., IBM Tech. Disc. Bull. 26 (1983) pp. 447–448.

Charles, et al., IEEE Trans. Magnet, vol. MAG-16 (1980) pp. 172–177.

*Primary Examiner*—Arthur P. Demers

*Attorney, Agent, or Firm*—Richard P. Crowley

[57] ABSTRACT

A stable ferrofluid composition and the method of preparing and using the ferrofluid composition, such as in a ferrofluid seal apparatus, and which ferrofluid composition comprises: a liquid carrier; ferromagnetic particles sufficient to provide magnetic properties to the ferrofluid dispersed in the liquid carrier; and a dispersing amount of a cationic surfactant to provide a stable ferrofluid composition. The stable ferrofluid compositions have improved electrical conductivity and are useful in sealing computer disc drives and in sputtering apparatus in the semiconductive industry.

30 Claims, No Drawings

STABLE FERROFLUID COMPOSITION AND METHOD OF MAKING AND USING SAME

BACKGROUND OF THE INVENTION

Ferrofluids or magnetic colloids are liquids with magnetic properties in which ferromagnetic materials are colloidally suspended. Such ferrofluids or magnetic liquids must show a high degree of stability (gravitational and magnetic field) in order to perform well in various commercial devices and be responsive to external magnetic fields. Generally a stable magnetic colloid or ferrofluid in a high magnetic field gradient requires small ferromagnetic particles of generally less than 100 angstroms in diameter. The ferromagnetic particles are typically coated with one or several separate layers of surfactants to prevent agglomeration in any particular liquid carrier.

Ferrofluids are widely known and used, and typical ferrofluid compositions are described, for example, in U.S. Pat. No. 3,700,595, issued Oct. 24, 1972, wherein anionic surfactants, such as fatty acids, alcohols, amines or amids and other organic acids are employed as dispersing surface active agents; U.S. Pat. No. 3,764,504, issued Oct. 9, 1973, wherein aliphatic monocarboxylic acids are employed as dispersing agents; U.S. Pat. No. 4,208,294, issued June 17, 1980, wherein a water based magnetic liquid is produced by the employment of $C_{10}$ to $C_{15}$ aliphatic monocarboxylic acids as acid dispersing agents; and U.S. Pat. No. 4,430,239, issued Feb. 7, 1984, wherein a stable ferrofluid composition is provided employing a phosphoric acid ester of a long-chain alcohol as a surfactant.

Various processes have been described for preparing magnetic colloids and ferrofluids, such as described more particularly in U.S. Pat. No. 3,917,538, issued Nov. 4, 1975, which provides a process for preparing an irreversibly flocked magnetic particle through the use of different dispersing agents which includes a variety of monionic and anionic surfactants, such as various petroleum sulfonates as the anionic surfactants and wherein the ferrofluids are prepared employing a grinding or ball mill technique; U.S. Pat. No. 4,019,994, issued Apr. 26, 1977, which employs a petroleum sulfonate with an aqueous carrier; U.S. Pat. No. 4,356,098, issued Oct. 26, 1982, which describes ferrofluid compositions composed of silicone-oil carrier and a dispersing amount of an anionic surfactant which forms a chemical bond with the surface of the magnetic particles as a tail group compatible or soluble in the silicone-oil carrier; and U.S. Pat. No. 4,485,024, issued Nov. 27, 1984, wherein a ferrofluid is produced through controlling the pH of the aqueous suspension of the ferromagnetic particles of an organic solvent together with surface active agents, such as fatty carboxylic acids.

A properly stabilized ferrofluid composition typically undergoes practically no aging or separation, remains liquid in a magnetic field and after removing of the magnetic field shows no hysteresis. Such a stabilized ferrofluid exhibits stability by overcoming generally three principal attractive forces: van der Waals, interparticles-magnetic and gravitational forces. The average particle needed in a ferrofluid depends on the selection of the ferromagnetic materials and typically may range from 20 to 300 Å, for example 20 to 200 Å, and for use in a very high magnetic field gradient may range up to 100 Å in diameter. Typically, the ferromagnetic particles must be covered by one or more layers of the selected surfactant in order to provide stability in an exterior magnetic field gradient. While there are many known ways to obtain small particles of the ferrites, cobalts, irons and other ferromagnetic particles, the type of surfactant and dispersing agent needed to stabilize these particular particles is an important aspect of the formation of stable ferrofluid compositions and the method of preparing such compositions.

The ferrofluid compositions have been used in a wide variety of commercial applications, such as for ferromagnetic seals, as dampening liquids in inertia dampers, as heat transfer liquids in the voice coil of loudspeakers, as bearing liquids, as ferrolubricants, for domain detection, for oil prospecting, and other applications.

SUMMARY OF THE INVENTION

The present invention relates to stable ferrofluid compositions and to a method of making and using such stable ferrofluid compositions. In particular, the present invention concerns a stable ferrofluid composition which employs a cationic surfactant as a dispersing agent in organic carrier liquids, and which stable ferrofluid compositions also exhibit an improvement in electrical conductivity.

It has been discovered that a stable ferrofluid composition may be prepared by employing a cationic surfactant as the dispersing agent for the ferromagnetic particles in the ferrofluid composition. One class of cationic surfactants so employed is composed of a quaternary ammonium surfactant wherein a head portion of the molecule is a quaternary ammonium and a tail or other portion of the cationic surfactant molecule is soluble in or compatible with the organic liquid carrier of the ferrofluid composition. It has been unexpectedly found that the employment of quaternary ammonium type cationic surfactants permits the preparation of stable ferrofluid compositions, in particular stable ferrofluid compositions of enhanced electrical conductivity. Such ferrofluid compositions are particularly useful where it is necessary to conduct an electrical charge or current from a rotary to a stationary member, or vice versa. Thus, the ferrofluid compositions not only provide for a ferrofluid sealing, dampening or other functioning, but also permit the use of these ferrofluid compositions in applications where transport of electric charge is required along with sealing or other functions. Generally non-aqueous or oil-base ferrofluid compositions of the proir art exhibit very high resistivities in the range of $10^{10}$ or $10^{9}$ ohm-cm and are basically dielectrics. Therefore, improved conductivity of ferrofluids particularly useful in ferrofluid seals for use in the computer seals and semi-conductive seal applications, such as computer disk drives where static charges are accumulated at the disk or which can be grounded through a conductive ferrofluid, are desirable.

In the prior art, ferrofluid compositions have employed anionic-type surfactants as surface active or dispersing agents. Typically a fatty acid, such as an oleic acid, is used as a most common example, while some prior art ferrofluid compositions use other anionic surfactants or nonionic surfactants. Generally the use of surfactants with COOH, $—SO_3H$, $—PO_3H_2$ groups has been considered to be the most effective polar groups in anionic surfactants for use in preparing ferrofluid compositions. These and other anionic surfactants are employed because it is considered that the ferromagnetic particles were considered to be positively charged, and thus were able to retain the anionic surfactants to form stable ferrofluids. However, it has been discovered that cationic surfactants, and more particularly quaternized ammonium surfactant agents, may be employed as dispersing agents to prepare a very stable ferrofluid composition, and which compositions also exhibit, improved generally by a factor of 10, electrical conductivity. The absorption of surfactants on the surface of ferromagnetic particles is a very complex surface phenomenon, so that the bonding between the ferromagnetic particles and the surface cannot be fully explained, through consideration such as electrostatic considerations and other types of bonding are possibly involved.

The stable ferrofluid compositions of the invention comprise: an organic liquid carrier; ferromagnetic particles in an amount sufficient to impart magnetic characteristics to the ferrofluid composition; and a dispersing amount of a quaternary ammonium surface active agent as a dispersing agent, and which quaternary ammonium surface active agent comprises a quaternary ammonium head portion and a long tail portion, which tail portion is soluble in or compatible with the organic liquid carrier selected. The stable ferrofluid compositions of the invention are usefully employed in all of those ferrofluid applications where ferrofluids are typically employed, and particularly in computer disk drive seals or in RF or DC sputtering apparatus where the transport of electrical charge through electrically conductive ferrofluid is an additional advantage.

The liquid carrier employed in preparing the ferrofluid composition of the invention may be any type of an organic liquid carrier, such as and not limited to: hydrocarbons; esters; fluorocarbons; silicones; mineral oils; polyphenyl ethers; polyglycols; fluorosilicone esters; polyolesters; glycol esters; and various other liquids, such as for example an ester based oil liquid or a polyalphaolefin base. The carriers can be oils or lubricants with molecular weight of about 80 to 700. Typically the organic liquid carriers are stable, nonvolatile liquids. The liquid carriers employed may contain or have various additives, such as stabilizers, antioxidants, corrosion inhibitors, viscosity index additives, or minor amounts of other additives to improve a selected quality or property of the composition.

The magnetic particles employed in the ferrofluid compositions may be those magnetic type of particles commonly employed in preparing ferrofluid compositions and typically comprise finely divided single domain particles of ferromagnetic materials, such as, but not to be limited to: magnetite; ferrites; iron; nickel; cobalt; metal carbides or metal oxides; metal alloys; and other finely divided materials which have or can be made to have magnetic properties when dispersed in a liquid carrier. One typical and preferred ferromagnetic particle comprises magnetite particles. The ferromagnetic particles employed are finely divided and are generally less than 1000 angstroms, but more typically less than 300 angstroms, such as for example about 20 to 200 angstroms in single domain particles.

The ferromagnetic particles of the ferrofluid composition are dispersed and stabilized through the employment of a cationic surfactant, i.e. having a positive charge. The amount and nature of the cationic surfactant employed as a dispersing agent may vary depending on the particular liquid carrier, the ferromagnetic particles and the size thereof, and the type of stability and dispersion desired. The ratio of the cationic surfactant as a dispersing agent to the ferromagnetic particles may vary, but generally in ferrofluid compositions ranges from about 0.5:1 to 20:1 by weight. The ferromagnetic particles are generally present in the ferrofluid composition in an amount ranging from about 5 to 20 percent by weight of the liquid carrier. The ferrofluid compositions prepared in accordance with the invention have varying saturization, magnetization values and typically range from 20 gauss to 900 gauss, for example 100 to 450 gauss, and range in viscosity from about 25 cp to 2000 cp, or typically 50 to 500 cp.

The cationic surfactants are composed of quaternary ammonium surfactant molecules, generally with two structural parts, a polar head group comprising the quaternary ammonium which attaches to the ferromagnetic particle surface or to a layer of another surfactant, and a tail group with properties similar to the surrounding fluid matrix or the carrier fluid, and typically being compatible with and soluble in the organic liquid carrier. Therefore, the selection of the particular tail group of the quaternized ammonium surfactant should be matched with the particular organic liquid carrier employed, for example a hydrocarbon tail group of a quaternized ammonium compound would typically be soluble in hydrocarbon oil or polyalphaolefine nonpolar-type organic liquid carriers, while tail groups having a hydroxyl or an oxygen-containing tail, e.g. OH groups, would be soluble and compatible in glycols, polyglycols, esters, esterglycols and the like. For example, a polyalkylene oxide, such as a polypropylene oxide tail group of a quaternized ammonium cationic surfactant is typically soluble in a polar organic liquid carrier, such as esters, polyesters, polyglycols or glycolesters. The employment of cationic surfactants as dispersing agents permits the dispersing of ferromagnetic particles in an entirely new family of organic liquid carriers or lubricants, such as polyolesters, glycols, silahydrocarbons and various other organic liquid carriers which may be used as oils, lubricants, bearing fluids and the like. Cationic surfactants of the invention which are insoluble in water also allow the possibility of making ferrofluid compositions of magnetic colloids compatible with water or alcohols. The ferrofluids employing the cationic surfactants may be used in all known applications of ferrofluids, such as in sealing, dampening, lubrication, heat transfer, domain detection, bearing fluids, and in other applications.

A wide variety of cationic surfactants may be employed as the dispersing agent of the invention where the tail portion of the surfactant molecule is soluble in or compatible with the carrier liquid, and in addition is of sufficient length in order to provide a stable ferrofluid composition, for example, typically the length of the molecular structure of the tail portion of the cationic surfactant should be more than about 20 angstoms to stabilize particles having a diameter of about 100 angstroms or more. The particularly preferred cationic surfactants of the invention comprise the quaternary ammonium cationic surfactant composed of a quaternary ammonium head group and a long tail portion, such as for example ranging in each surfactant molecule from about 10 to 50 angstroms in overall length or having $C_6$–$C_{30}$, e.g. $C_8$–$C_{18}$, carbon atoms or length.

Some quaternary ammonium cationic surfactants useful as dispersing agents in the ferrofluid composition would comprise, but not be limited to the following representative classes such as: quaternary imidazoline salts which contain a heterocyclic ring which contains a quaternary ammonium group and includes a long chain, such as a fatty acid substituent group; aliphatic quaternary ammonium salts where at least one of the groups and often two of the groups through the quaternary ammonium and nitrogen comprises a long chain group, such as a fatty acid group; and quaternary acylated polyamine salts which contain, for example, a long chain alkoxy group such as an ethoxy or propoxy group, which compounds are particularly useful as dispersing agents where the liquid carrier comprises an oxygen-containing liquid, such as an ester, glycol or polyester. The cationic surfactant should be employed in an amount sufficient to provide for a stable dispersion, and may be used alone or in combination with other surfactants, such as nonionic surfactants (but not directly with anionic surfactants), and with other various additives or used in combination.

The structural formulas of representative cationic surfactants of the invention are as follows:

I

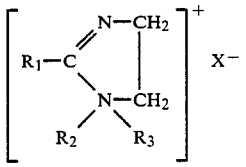

Wherein $R_1$ is a long chain aliphatic, or alicyclic radical or aryl, or alkyl-aryl radical, such as a monocarboxylic acid particularly a long chain $C_8$–$C_{18}$ fatty acid radical like oleic, stearic, myristic, lauric, etc. or a mixture thereof; $R_2$ and $R_3$ are hydrogen or alkyl, such as $C_1$–$C_4$ like methyl, or hydroxy-containing $C_2$–$C_6$ alkyl like —$C_2H_4OH$ radicals. A representative compound would be whereas $R_1$ is a mixture of $C_{12}$–$C_4$ fatty acids, $R_2$ and $R_3$ are $CH_3$ radicals, and X is acetate or Cl.

II

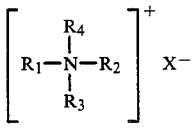

Wherein $R_1$ is a radical as in formula I, $R_2$ and $R_3$ are poly alkoxy radicals, such as polypropyloxyenated and polyethoxylated radicals, and $R_4$ is a lower alkyl such as methyl radical. A representative compound would be where $X^-$ is an acetate or Cl, $R_4$ is $CH_3$, and $R_2$ and $R_3$ are polyoxypropylenated radicals of 1 to 10 propoxy groups.

$$[C_nH_{2n+1}CONH(CH_2)_3HN(CH_3)_2]^+X^- \quad \text{III}$$

Wherein n is a number from 1 to 20, e.g. 6 to 15. A representative compound would be where $X^-$ is acetate or Cl and n is 3 to 8. In all the formulas $X^-$ represents a cationic salt radical, such as a halide like chloride, a nitrate, a sulfate, a phosphate, or weak organic acid like an acetate radical.

The ferrofluid composition may be prepared employing the usual and generally accepted techniques of ball milling and grinding, as in the prior art, to prepare the ferrofluid compositions. The cationic surfactants may be used in conjunction with anionic and nonionic surfactants or may be used as one surfactant layer; while other surfactants, anionic, nonionic or other cationic surfactants, may be used in another layer or to complete the first layer. For example, the ferromagnetic particles may be dispersed first with an anionic surfactant, and then a separate surfactant to complete the layer or as a second layer of a cationic surfactant is employed, or vice versa, to provide stable ferrofluid compositions. The techniques for such multiple layer dispersing of magnetic particles is known in the art for anionic surfactants. Thus, the stable ferrofluid composition may comprise cationic surfactants together with other surfactants, typically a first dispersing layer of an anionic fatty acid surfactant followed by a final dispersing of the anionic surfactant magnetic particles with a cationic surfactant.

The ferrofluid compositions employing the quaternary ammonium surfactants as dispersing agents also provide for improved electrical conductivity over the usual nonionic or anionic dispersing agents. Typically the resistivity is in the range of $10^6$ ohm-cm or less, so that a properly designed ferrofluid seal employing the ferrofluid composition may have a resistance of about $10^5$ ohms or less. The electrically conductive ferrofluid may be used in disk drive applications to provide the conventional sealing function, and further for the conduction of electrical charge, thereby eliminating the grounding silver graphite button presently employed in spindles. The ferrofluids are particularly useful in a rotating computer disk drive spindle wherein static charge is produced to the disk, and which charge build-up can lead to a spark within the disk in the magnetic head located within 15 microinches of the disk. Such static spark may locally damage the alignment of meteor particles resulting in the loss of information. However, by grounding the computer disk drive spindle and employing the electrically conductive ferrofluid composition containing the quaternary ammonium surfactant, it is possible to avoid sparking.

The invention will be described for the purposes of illustration only in connection with certain embodiments; however, it is recognized that various changes, additions, modifications, and improvements in the invention may be made to these illustrative embodiments by those persons skilled in the art and all falling within the spirit and scope of the invention.

DESCRIPTION OF THE EMBODIMENTS

EXAMPLE 1

Using Quaternary Imidozoline Salts Cationic Surfactant

The magnetic ($Fe_3O_4$) was prepared using 240 grams of Fe $SO_4$, 425 ml of 45% Fe $Cl_3$ and 250 ml water. The mixture of these three components is maintained at 5° C. under constant agitation to assure that Fe $SO_4$ is completely dissolved.

$Fe_3O_4$ was precipitated from the solution by the slow addition of ammonia solution 30% $NH_3$ to reach the pH of 12. The solution must be cooled to 5° C. during $F_3O_4$ precipitation in order to reach average magnetic particles diameter in the range of 100 Å. At pH 12 and 5° C. the suspension is agitated for more than 30 minutes and then the temperature is increased to 90°–100° C. This temperature is maintained for 60 minutes.

The precipitated $Fe_3O_4$ is magnetically separated from the salt/ammonia solution and is washed of salts using 500 ml of water. The operation is repeated 4 to 6 times. The magnetic particles are washed 2 to 4 times with acetone in order to remove as much of the water content as possible.

The magnetic particles are thoroughly dryed at 80° C. in a vacuum oven by removing the acetone and traces of water. 10 grams of dryed $Fe_3O_4$ is added to a ball mill and mixed with 15–20 gm of a mixed fatty quaternary imidozoline salt as a cationic surfactant (Witcamine Al 42–12 of Witco Chemical Co.) and 200 ml of heptane. After 20 days of grinding the based heptane ferrofluid has a saturation magnetization of about 350 gauss.

The ferrofluid is mixed with a 200 ml of an organic liquid carrier such as polyalphaolefine oil (Emery 3002 a polyalphaolefine oil having a pour point of −55° C., flash point 155° C. and viscosity index (ASTM D-1158) 122; and Emery 3004 a polyalphaolefine oil having a pour point of −65° C., flash point 210° C. and viscosity index (ASTM D-1158) 121; both products of Emery Industries). The suspension is heated at 110° C. until all heptane has been evaporated.

The ferrofluid has a saturation on magnetization of 350 gauss and a viscosity of 20 to 40 cp (@27° C.) depending on the type of polyalphaolefine oil used as that final carrier.

EXAMPLE 2

Using Polypropoxy Quaternary Ammonium Chloride Cationic Surfactant

The magnetite ($Fe_3O_4$) was prepared using 240 grams of Fe $SO_4$, 425 ml of 45% Fe $Cl_3$ and 250 ml of water. The mixture of these three components is maintained at 5° C. under constant agitation to ensure that the Fe $SO_4$ is completely dissolved.

$Fe_3O_4$ was precipitated from the solution by the slow addition of ammonia solution (30% $NH_3$) to reach the pH of 12. The solution must be cooled at 5° C. during $Fe_3O_4$ precipitation in order to obtain average magnetic particle diameter in the range of 100Å. At pH 12 and at 5° C. the suspension is agitated for more than 30 minutes and then the temperature is increased to 90°–100° C. This temperature is maintained for 60 more minutes.

In the suspension 100 ml of soap is added under a strong agitation. The soap composition is isostearic acid: AMMONIA (30%$NH_3$) solution in volume ratio of 1:1.

The suspension having some composition is mixed for 30 minutes at 90°–100° C.; then 350 cc of an isoparofinic hydrocarbon fraction (ISOPAR-G, having a boiling point range of 160 to 176° C. of Exxon Chemical Co.) is added to the suspension under constant agitation.

After 60 minutes of strong agitation, all the magnetite particles, well covered with isostearic acid, are suspended in the hydrocarbon friction. The mixture was settled for 120 minutes. The upper layer contain the hydrocarbon base magnetic colloid. The supernatant liquid was transferred into another beaker. The hydrocarbon base magnetic colloid (300 cc) was mixed with 200 cc of acetone. The magnetite was allowed to settle and the supernatant liquid was siphoned off.

This operation is repeated two more times in order to eliminate the excess of isostearic acid. The acetone wet slurry was added in a beaker containing 400 cc of heptane.

This slurry was heated to 80° C. in order to remove the acetone. The remaining fluid is 450 cc heptane based magnetic colloid having approximately 400 gauss saturation magnetization.

A total of 55 gr of a polypropoxy quaternary ammonium acetate cationic surfactant (EMCOL cc 55, a polypropoxy quaternary ammonium acetate of Witco Chemical Co.) surfactant was added to the heptane base magnetic colloid at 70° C. under constant stirring. After 30 minutes of agitation at this temperature the absorption of the second surfactant on the magnetic particles was considered complete. A total of 300 cc of liquid carrier of a polyolester (Mobil Ester P-42, having a pour point of −51° C., flash point 243° C., viscosity index 134 of Mobil Chemical Co.) was added under agitation to the heptane base magnetic colloid. The mixture was held at 100° C. until all the heptane was removed.

The final ferrofluid was kept in a high magnetic field gradient at 80° C. for 24 hours in order to remove large agglomerates. The supernatant fluid was filtered and the final magnetic colloid was 350 gauss in saturation magnetization and 60 cp in viscosity at 27° C. The large aggregates can also be separated by centrifugation in a field of 200–1000 g.

EXAMPLE 3

Using an Acylated Polyamine Salts-Short Chain Carboxylic Acid

A 450 cc heptane base magnetic colloid with about 450 gauss saturation magnetization was prepared as described in Example 2.

A total of 60 gr of a cationic surfactant (an acrylated polyamine salt of short chain carboxylic acid having the formula $[C_{17}H_{35}CONH(CH_2)_2HN(CH_3O_2]^+$ acetate) was added to the heptane base magnetic colloid at 70° C. under constant stirring. After 30 minutes of agitation the absorption of the second surfactant on magnetic particles was considered complete. A total 300 cc of a polyalphaolefine oil (Mobil SMF 41, a polyalphaolefine oil pour point −68° C., flash point 218° C., viscosity of 120 of Mobil Chemical Co.) was added under agitation to the heptane based magnetic colloid. The mixture of these components was held at 110° C. until all the heptane was evaporated.

The final ferrofluid was further treated as described in Example 2. The final magnetic colloid was 300 gauss in saturation magnetization 50 cp in viscosity at 27° C.

What is claimed is:

1. A stable ferrofluid composition which comprises:

(a) an organic liquid carrier;

(b) magnetic particles in an amount sufficient to provide magnetic properties to the ferrofluid composition; and (c) a dispersing agent in an amount sufficient to disperse and stabilize the magnetic particles in the organic liquid carrier, which dispersing agent comprises:

a cationic surfactant composed of a cationic positively charged head portion and a long-chain tail portion, the long-chain tail portion compatible with or soluble in the organic liquid carrier, to provide a stable ferrofluid composition having an electrical resistivity of about $10^6$ ohms-cm or less.

2. The composition of claim 1 wherein the cationic surfactant is present in a ratio by weight of surfactant to magnetic particles from about 1:1 to 20:1.

3. The composition of claim 1 wherein the organic liquid carrier comprises a hydrocarbon or polyalphaolefine oil, and wherein the long chain portion of the cationic surfactant comprises a $C_6$ to about $C_{30}$ hydrocarbon.

4. The composition of claim 1 wherein the cationic surfactant comprises from about 4 to 25 moles of a polyalkoxylate portion, and wherein the organic liquid carrier comprises an ester, a glycol or an esterglycol.

5. The process of claim 1 wherein the organic liquid carrier is selected from the group consisting of liquid hydrocarbons, liquid esters, liquid glycols and silicone oils.

6. The composition of claim 1 wherein the magnetic particles comprise ferromagnetic particles having a diameter ranging from about 20 to 500 angstroms.

7. The composition of claim 1 wherein the magnetic particles comprise ferromagnetic particles having a diameter of from about 20 to 200 angstroms, and wherein the cationic surfactant has a long chain portion of about 10 to 50 angstroms.

8. The composition of claim 1 wherein the cationic surfactant comprises a quaternary ammonium cationic surfactant having a quaternary ammonium head portion of the molecule and a long chain tail portion of the molecule, the long chain tail portion of the molecule selected from the group consisting of: a long chain hydrocarbon; a long chain fatty acid; or a poly alkoxylated chain.

9. The composition of claim 1 wherein the cationic surfactant is selected from a group consisting from a fatty acid quaternary imidazoline salt; a polypropoxy quaternary ammonium salt; an acylated polyamine salt; and combinations thereof.

10. The composition of claim 1 wherein the cationic surfactant comprises a quaternary ammonium cationic surfactant having the structural formula:

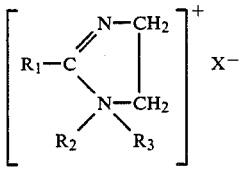

wherein $R_1$ is a long-chain aliphatic radical; $R_2$ and $R_3$ are selected from the group consisting of hydrogen or an alkyl and a hydroxy-containing alkyl radical; and $X^-$ is an anionic-salt radical.

11. The composition of claim 1 wherein the cationic surfactant comprises a quaternary ammonium surfactant having the structural formula:

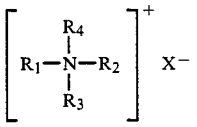

wherein $R_1$ is a long chain radical; $R_2$ and $R_3$ are poly alkoxy radicals, and $R_4$ is a lower alkyl radical; and $X^-$ is an anionic salt radical.

12. The composition of claim 1 wherein the cationic surfactant comprises a quaternary ammonium cationic surfactant having the structural formula:

$$[C_nH_{2n+1}CONH(CH_2)_3HN(CH_3)_2]^+X^-$$

wherein n is a number from 1 to 20; and $X^-$ is an anionic salt radical.

13. The composition of claim 1 wherein the composition has an electrical resistivity of about $10^5$ ohm-cm or less.

14. The composition of claim 1 which includes a nonionic or anionic surfactant.

15. The composition of claim 1 which includes a first dispersing agent of a long-chain acid anionic surfactant forming a first layer on the magnetic particles and a second dispersing agent of a cationic surfactant which comprises a quaternary ammonium surfactant having a tail portion soluble in the organic liquid carrier forming a second layer.

16. A stable ferrofluid composition, which composition comprises:

(a) an organic liquid carrier, which organic liquid carrier is selected from the group consisting of hydrocarbons, esters and glycols;

(b) finely divided ferromagnetic particles in an amount to provide magnetic properties of the ferrofluid composition and having a diameter ranging from about 20 to 300 angstroms; and (c) a dispersing agent in an amount sufficient to disperse and stabilize the magnetic particles in the organic liquid carrier, which dispersing agent comprises a quaternary ammonium surfactant selected from a group consisting of:

fatty quaternary imidozoline salts; polypropoxy quaternary ammonium salts; acylated polyamine salts; and combinations thereof, to provide a stable ferrofluid composition having an electrical resistivity of about $10^6$ ohms-cm or less.

17. The composition of claim 16 which includes a first dispersing layer of an anionic surfactant on the ferromagnetic particles and a second dispersing layer of the cationic surfactant.

18. A method of providing a ferrofluid seal about a rotating member subject to the accumulation of static charges, which method comprises:

sealing the rotary member with an electrically conductive ferrofluid composition, which ferrofluid composition includes therein a dispersing and electrically conductive amount of a quaternary ammonium cationic surfactant, to provide an electrically conductive path to ground for the electrically conductive ferrofluid composition, to provide a ferrofluid composition having an electrical resistivity of $10^6$ ohms-cm or less.

19. A method of preparing a stable ferrofluid composition, which method comprises dispersing magnetic particles in an organic liquid carrier employing a dispersing amount of a cationic surfactant sufficient to provide a stable, dispersed ferrofluid composition, the cationic surfactant composed of a positively charged head portion and a long-chain tail portion, the tail portion of the cationic surfactant soluble in the organic liquid carrier, to provide a stable ferrofluid composition having an electrical resistivity of about $10^6$ ohms-cm or less.

20. The method of claim 19 wherein the cationic surfactant comprises a quaternary ammonium cationic surfactant having a long chain hydrocarbon or alkyoxy group.

21. The method of claim 19 wherein the organic liquid character comprises a hydrocarbon or polyalphaolefine oil, and which method comprises: dispersing the magnetic particles in the organic liquid carrier in the presence of from about 5 to 25 percent by weight of the magnetic particles of an anionic surfactant to provide a first layer of surfactants, and thereafter dispersing the anionic surfactant containing magnetic particles in the organic liquid carrier employing a cationic surfactant, whereby the ratio by weight of the cationic surfactant to magnetic particles varies from about 1:1 to 40:1.

22. The method of claim 21 wherein the anionic surfactant has more than 8 carbon atoms and contains one or more polar groups.

23. The method of claim 19 wherein the cationic surfactant employed as the second layer surfactant in the method of dispersing and preparing the ferrofluid composition comprises: a quaternary ammonium cationic surfactant having a $C_6$–$C_{30}$ hydrocarbon or alkoxy tail portion.

24. The method of claim 19 wherein the cationic surfactant employed as a second layer surfactant has from about 5 to 25 moles of a polyoxyethoxylate tail portion, and wherein the organic liquid carrier comprises an ester, a glycol or an ester-glycol.

25. The method of claim 19 wherein the cationic surfactant is selected from a group consisting of: a fatty acid quaternary imizozoline salt; a polypropoxy quaternary ammonium salt; an acylated polyamine salt; and combinations thereof.

26. The method of claim 21 wherein the anionic surfactant comprises a long chain carboxylic acid anionic surfactant and wherein the cationic surfactant comprises a long chain quaternary ammonium surfactant.

27. The method of claim 26 wherein the cationic surfactant is selected from a group consisting of: a fatty acid quaternary imidozoline salt; a polypropoxy quaternary ammonium salt; an acylated polyamine salt; or combinations thereof.

28. The composition of claim 10 wherein $R_1$ comprises a $C_8$–$C_{18}$ monocarboxylic acid radical, $R_2$ and $R_3$ are selected from the group consisting of hydrogen or $C_1$–$C_4$ alkyl and —$C_2H_4OH$ radicals.

29. The composition of claim 11 wherein $R_1$ comprises a monocarboxylic acid radical, and $R_2$ and $R_3$ are polyoxypropylenated radicals, and $R_4$ is a methyl radical.

30. The composition of claim 17 wherein the anionic surfactant comprises a long-chain carboxylic acid anionic surfactant.

* * * * *